US009151028B2

(12) United States Patent
Bell

(10) Patent No.: US 9,151,028 B2
(45) Date of Patent: Oct. 6, 2015

(54) FLUSHING VALVE

(75) Inventor: Thomas Henry Bell, Perth (GB)

(73) Assignee: GTP DEVELOPMENTS LIMITED, Easton (GB)

( * ) Notice: Subject to any disclaimer, the term of this patent is extended or adjusted under 35 U.S.C. 154(b) by 1428 days.

(21) Appl. No.: 12/681,315

(22) PCT Filed: Oct. 3, 2008

(86) PCT No.: PCT/GB2008/050899

§ 371 (c)(1),
(2), (4) Date: Jul. 19, 2010

(87) PCT Pub. No.: WO2009/044206

PCT Pub. Date: Apr. 9, 2009

(65) Prior Publication Data

US 2010/0306911 A1 Dec. 9, 2010

(30) Foreign Application Priority Data

Oct. 5, 2007 (GB) ..... 0719520.9

(51) Int. Cl.
*E03D 1/06* (2006.01)
*E03D 1/36* (2006.01)

(52) U.S. Cl.
CPC ..... *E03D 1/36* (2013.01)

(58) Field of Classification Search
USPC ..... 4/388, 379, 384; 251/324, 55, 51, 28, 251/29
See application file for complete search history.

(56) References Cited

U.S. PATENT DOCUMENTS

| | | | | |
|---|---|---|---|---|
| 2,760,204 | A * | 8/1956 | Joanis | 4/367 |
| 5,333,332 | A * | 8/1994 | Kam | 4/326 |
| 6,315,212 | B1 * | 11/2001 | Heffernan et al. | 236/62 |
| 6,321,395 | B1 * | 11/2001 | Parsons et al. | 4/378 |
| 6,385,787 | B1 * | 5/2002 | VanVoorhies | 4/333 |
| 6,536,053 | B2 * | 3/2003 | Icking et al. | 4/367 |

FOREIGN PATENT DOCUMENTS

| | | | |
|---|---|---|---|
| EP | 1162320 | A1 | 12/2001 |
| EP | 1162320 | A1 * | 12/2001 |
| WO | WO-2005/001319 | A1 | 1/2005 |
| WO | WO-2005/014943 | A1 | 2/2005 |

OTHER PUBLICATIONS

EP 1162320.*
Van Bost, Sonia, "International Search Report", for PCT/GB2008/050899 as mailed Apr. 14, 2009, 4 pages.

* cited by examiner

*Primary Examiner* — Lauren Crane
(74) *Attorney, Agent, or Firm* — Winstead PC

(57) ABSTRACT

A flushing valve suitable for reducing water wastage from a cistern of a toilet is described. The flushing valve comprising an inlet valve, an outlet valve and a timer valve. The timer valve is mechanically connected to both the inlet valve and the outlet valve so as to control their movement between an open and a closed position such that the timer valve prevents both the inlet valve and the outlet valve from simultaneously being in their open positions. By preventing the inlet valve and the outlet valve from simultaneously being in their open positions results in the fact that the flushing valve does not allow the cistern to start to refill until after the flush process is complete. This results in a significant reduction in the volume of water passing through the cistern during each flushing cycle.

25 Claims, 8 Drawing Sheets

FLUSHING VALVE

Figure 1:
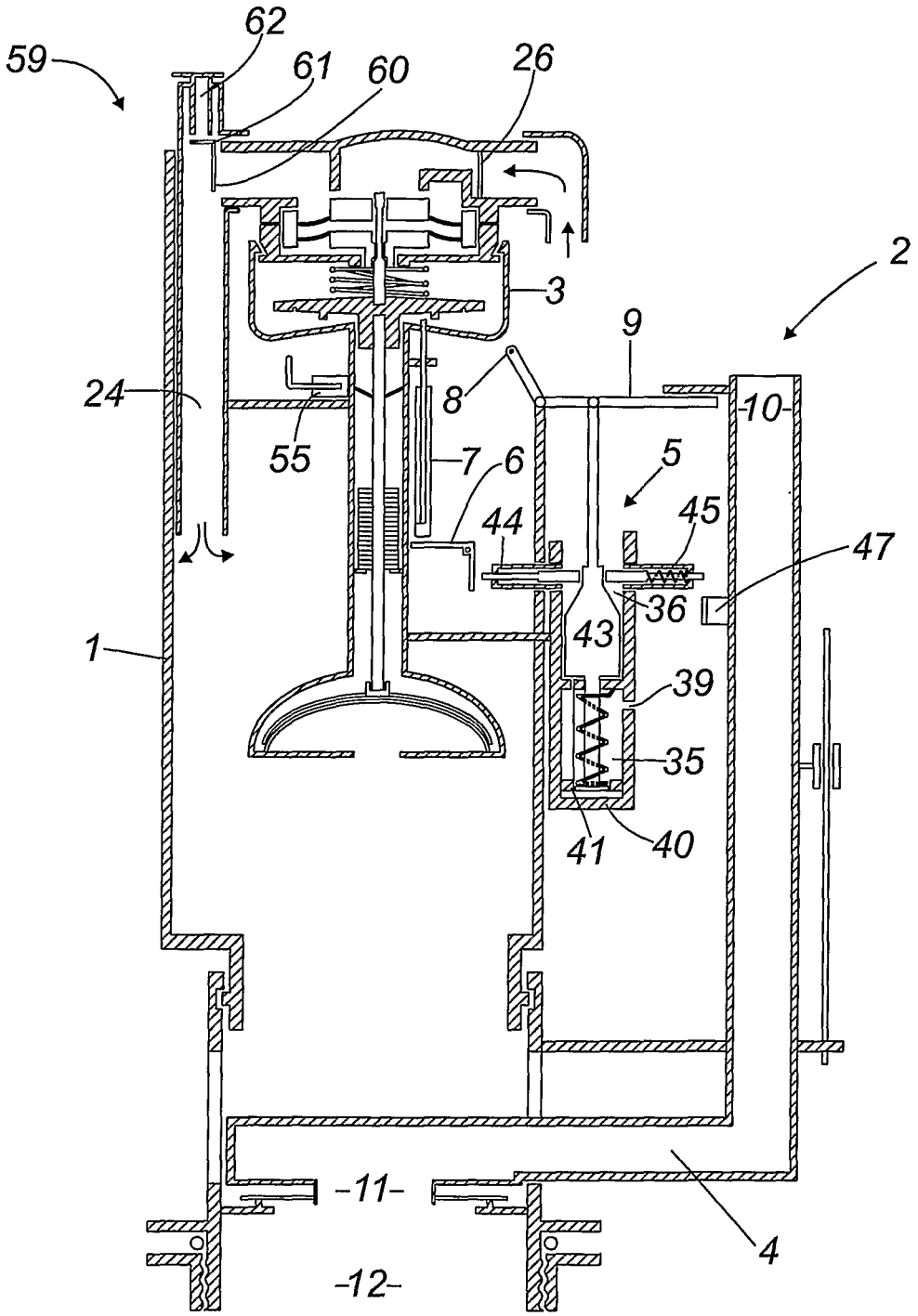

The present invention relates to the field of valves and, in particular, to a flushing valve suitable for reducing water wastage from a cistern of a toilet.

It is estimated that the daily flushing of toilets in the UK results in approximately 3030 million liters of water being flushed away. This value comprises around 690 million liters from domestic toilets, 480 million liters from work place toilets, and approximately 1860 million liters from toilets employed by the roaming population. As a result over three billion liters of water goes to waste or is required to be retreated each day.

Toilet cisterns are typically sold as nominal six, seven, or eight liter systems. In practice however, each flush uses more than the associated nominal value because as soon as the toilet is flushed the cistern immediately starts to refill. Generally a flush is designed to allow as much water as possible to pass from the cistern into the bowl in order to carry away waste. As a result, any additional water which enters the bowl at a relatively low flow rate is found not to affect the efficiency of the flush and so is simply wasted.

It takes between five and six seconds to flush most cistern models, regardless of their volume. It is within that time span that the wastage of water occurs. Based on these figures it is estimated that, on average, one liter of water is wasted per flush.

There are currently three main types of flushing systems in use in the UK market today, namely:

1) siphon systems where the water from the cistern can only be used to flush the toilet when the siphon is primed by the user. When the flushing arrangement is not being operated it can not pass any water to the toilet bowl;
2) drop valve systems where either a single push button is employed to activate a full flush or two buttons are employed to operate a dual flush; and
3) flapper valve systems which are commonly used in the US. Generally, these comprise a single flushing cistern valve having a chain mechanism located between a handle and a flapper valve. On activating the handle the flap is lifted so as to allow water to enter the bowl and flush the waste away.

All of the above systems operate in conjunction with an inlet valve employed to regulate the control of water from a mains or tank feed into the cistern. The inlet valves themselves are actuated by using a float, typically mounted on the end of a pivot arm. When the water level within the cistern rises, the buoyancy of the float causes the pivot arm to rise exerting its upward force on the end of a piston, or similar device, so as to close the inlet valve.

Over and above the above described problems of water wastage the known flushing systems also suffer from a number of additional problems, including:

Reliability

The traditional ball float inlet valve design is prone to early failure, is expensive to replace, and is bulky especially if fitted in combination with a conventional flushing system. Alternatively, employing an equilibrium valve allows for the use of a shorter pivot arm and float, however this still takes up a significant amount of space within the cistern. More recently some manufacturers have redesigned the float to move vertically on a linear track thus saving space when compared to the ball float valve as well as helping with minimising the effect of water hammer, see below.

Water Hammer

An effect known as Water Hammer is frequently caused by the quick closing of a tap on the same supply pipe as the flushing system. By arresting the flow, extra pressure is transmitted to the ball valve piston causing the ball to momentarily further submerge. This results in the consequential reaction of the ball starting to vibrate up and down thus causing a humming or chattering noise.

Developing a Dual Flush System

Incorporating a dual flush within the siphon, drop valve or flapper systems requires complex modifications to be made. For example, the siphon system predominantly functions in a single flush mode as it is unintuitive to develop a dual flush form since this would require the user to operate a single handle in two different modes. Such systems would also be bulky, especially when combined with a ball float inlet valve.

In a similar manner, a drop valve system combined with a float actuated, inlet valve is also a complicated assembly requiring numerous mechanical parts. These two assemblies are independent in their operation and have to be mounted and installed separately. As a result they take up a considerable space within the cistern and thus restrict design improvements of the cisterns.

The flapper valve system is equally bulky and operates only in single flush mode, and like the other models restricts improved cistern design due to the space it takes up in combination with the inlet valve. This issue is partially alleviated by employing an equilibrium valve as the inlet valve since this has a shorter arm and float.

In addition to the above it is also appreciated by those skilled in the art this it is getting more complicated to carry out repairs to a cistern due to the variety of valves of various types on the market today. This has the effect of burdening the public with undue plumbing repair bills.

It is an object of the present invention to obviate or mitigate at least one of the foregoing disadvantages of the flushing valves known to those skilled in the art.

In particular, it is an object of an aspect of the present invention to provide a flushing valve which reduces the level of water wastage experienced by a cistern when a toilet is flushed.

SUMMARY OF INVENTION

According to a first aspect of the present invention there is provided a flushing valve for controlling the flush of a cistern, the flushing valve comprising an inlet valve, an outlet valve and a timer valve, the timer valve being mechanical connected to both the inlet valve and the outlet valve so as to control their movement between an open and a closed position wherein the timer valve is adapted so as to prevent both the inlet valve and the outlet valve from simultaneously being in their open positions.

By preventing the inlet valve and the outlet valve from simultaneously being in their open positions results in the fact that the flushing valve does not allow the cistern to start to refill until after the flush process is complete. This results in a significant reduction in the volume of water passing through the cistern during each flushing cycle.

Preferably flushing of the cistern causes the timer valve to move the flushing valve from a first configuration where the inlet valve and the outlet valve are in their closed positions to a second configuration where the inlet valve remains closed while the outlet valve moves to its open position. When the flushing valve is in the second configuration the cistern is allowed to empty of water, thus acting to flush an associated toilet.

Most preferably the timer valve maintains the flushing valve in the second configuration for a predetermined time period before moving the flushing valve to a third configuration wherein the outlet valve is closed while the inlet valve moves to its open position. In this third configuration the flushing valve allows the cistern to refill with water.

Preferably the timer valve comprises a timer valve chamber and a piston rod arranged to move between an extended and retracted configuration relative to the timer valve chamber.

Most preferably the piston rod is biased towards the retracted position.

Preferably the timer valve further comprises a pivotable rod attached to both the piston rod and a flushing mechanism of the cistern and adapted to interact with the outlet valve wherein activation of the flushing mechanism acts to pivot the rod so as to move the piston rod between its retracted and extended configuration and to move the outlet valve from its closed position to its open position.

Most preferably the timer valve further comprises a first pall adapted to move from a retracted configuration to an extended configuration as the piston rod moves from its retracted configuration to its extended configuration wherein when the first pall is in the extended configuration the inlet valve is held in its closed configuration.

Most preferably the timer valve further comprises a second pall adapted to move from a retracted configuration to an extended configuration when the piston rod moves from its retracted configuration to its extended configuration wherein when the second pall is in the extended configuration the outlet valve is held in its open configuration.

Preferably the timer valve chamber comprises a first chamber adapted to house a first section of the piston rod wherein the first section of the piston rod has a tapered external surface arranged to interact with both the first and second palls.

Preferably the timer valve chamber further comprises a second chamber adapted to house a second section of the piston and a bias means for biasing the piston rod towards its retracted configuration.

Preferably the second chamber further comprises a non-return valve wherein the non return valve moves from a closed position to an open position as the piston rod is moved towards its extended configuration.

Most preferably the second chamber further comprises an exhaust wherein the exhaust provides a means for fluid to exit the second chamber as the piston rod moves from its extended configuration to its retracted configuration. It is the control of rate at which fluid exits the exhaust which determines the period of time it takes the flushing valve to move from its second configuration to its third configuration.

Preferably the second section of the piston comprises a T-shaped body upon which is located an aperture wherein fluid must pass through the aperture before exiting the second chamber via the exhaust. This arrangement provides for further control of the rate at which the flushing valve to move from its second configuration to its third configuration.

Optionally the second chamber further comprises a needle arranged to locate with the aperture. Preferably the needle is tapered such that the rate at which fluid passes through the aperture is constant.

Optionally the inlet valve comprises a non-return valve located so as to prevent water exiting the cistern via the inlet valve. Incorporation of this no-return valve renders the flushing valve anti-siphon proof.

Preferably the inlet valve comprises a pressure head valve for use with a variable head of fluid, the pressure head valve comprising a first diaphragm mechanism and pressure transfer apparatus, wherein the pressure transfer apparatus provides a means for transferring a fluid pressure associated with the variable head of the fluid to the first diaphragm mechanism so as to move the inlet valve between an open an closed configuration.

Most preferably the first diaphragm mechanism comprises two diaphragms adapted to form a diaphragm chamber and a pin located so as to pass through apertures located within the two diaphragms.

Employment of a diaphragm chamber provides the inlet valve with the advantage that it does not suffer from the problematic effects of water hammer.

Preferably the pressure transfer apparatus comprises a second diaphragm mechanism arranged so as to interact with a first end of an inlet valve rod wherein a second end of the inlet valve rod is arranged so as to control a position of the pin relative to the diaphragm chamber.

Preferably the pressure transfer apparatus further comprises an adjuster wherein the adjuster provides a means for changing the relative separation between the second diaphragm mechanism and the first end of an inlet valve rod.

Optionally the inlet valve further comprises an automatic cut out valve wherein the automatic cut out valves causes the inlet valve to move to its closed position when the volume of water within the cistern rises above a predetermined value.

Preferably the automatic cut out valve comprises a plurality of fibre washers located around the inlet valve rod.

Preferably the outlet valve comprises a drop valve.

Most preferably the drop valve comprises an overflow tube. Preferably the drop valve further comprises a flexible flap located on the overflow tube wherein the flexible flap is arranged so as to interact with the second pall.

Optionally the overflow tube comprises a telescopic tube.

Most preferably the flushing valve further comprises a dual flushing mechanism wherein the dual flushing mechanism comprises a first mechanism, activation of which fully extends the piston rod from the timer valve chamber, and a second mechanism, activation of which only partially extending the piston rod from the timer valve chamber.

Preferably the second mechanism comprises an adjuster which allows the amount by which the piston rod is partially extended from the timer chamber to be varied.

Preferably the flushing valve further comprises height adjuster that provides a means for adjusting the height of the inlet valve relative to the timer valve. The employment of the height adjuster is particularly useful when the inlet valve comprises a pressure head valve.

According to a second aspect of the present invention there is provided a pressure head valve for use with a variable head of fluid, the pressure head valve comprising a first diaphragm mechanism and pressure transfer apparatus, the pressure transfer apparatus providing a means for transferring a fluid pressure associated with the variable head of the fluid to the first diaphragm mechanism so as to move the pressure head valve between an open an closed configuration.

wherein the first diaphragm mechanism comprises two diaphragms adapted to form a diaphragm chamber and a pin located so as to pass through apertures located within the two diaphragms.

Employment of a diaphragm chamber provides the pressure head valve with the advantage that it does not suffer from the problematic effects of water hammer.

Preferably the pressure transfer apparatus comprises a second diaphragm mechanism arranged so as to interact with a first end of a valve rod wherein a second end of the valve rod is arranged so as to control a position of the pin relative to the diaphragm chamber.

Preferably the pressure transfer apparatus further comprises an adjuster wherein the adjuster provides a means for changing the relative separation between the second diaphragm mechanism and the first end of an inlet valve rod.

Optionally the pressure head valve further comprises an automatic cut out valve wherein the automatic cut out valves causes the pressure head valve to move to its closed position when the volume of water within the cistern rises above a predetermined value.

Preferably the automatic cut out valve comprises a plurality of fibre washers located around the valve rod.

According to a third aspect of the present invention there is provided a timer valve comprising a timer chamber;

a piston rod arranged to move between a retracted and extended configuration relative to the chamber;

and at least one pall adapted to move from a retracted configuration to an extended configuration as the piston rod moves from its retracted to its extended configuration wherein the piston rod is adapted such that the at least one pall remains in its extended configuration for a predetermined period of time as the piston rod moves from its extended configuration to its retracted configuration.

Most preferably the piston rod is biased towards its retracted configuration.

Preferably the at least one pal is biased towards its retracted position.

Preferably the timer chamber comprises a first chamber adapted to house a first section of the piston rod wherein the first section of the piston rod has a tapered external surface arranged to interact with the at least one pall.

Preferably the chamber further comprises a second chamber adapted to house a second section of the piston and a bias means wherein the bias means interacts with the second piston section so as to bias the piston rod towards its retracted configuration.

Preferably the second chamber further comprises a non-return valve wherein the non return valve moves from a closed position to an open position as the piston rod is moved towards its extended configuration.

Most preferably the second chamber further comprises an exhaust wherein the exhaust provides a means for fluid to exit the second chamber as the piston rod moves from its extended configuration to its retracted configuration.

Preferably the second section of the piston comprises a T-shaped body upon which is located an aperture wherein fluid must pass through the aperture before exiting the second chamber via the exhaust.

Optionally the second chamber further comprises a needle arranged to locate with the aperture. Preferably the needle is tapered such that the rate at which fluid passes through the aperture is constant.

SPECIFIC DESCRIPTION

Figure 2:
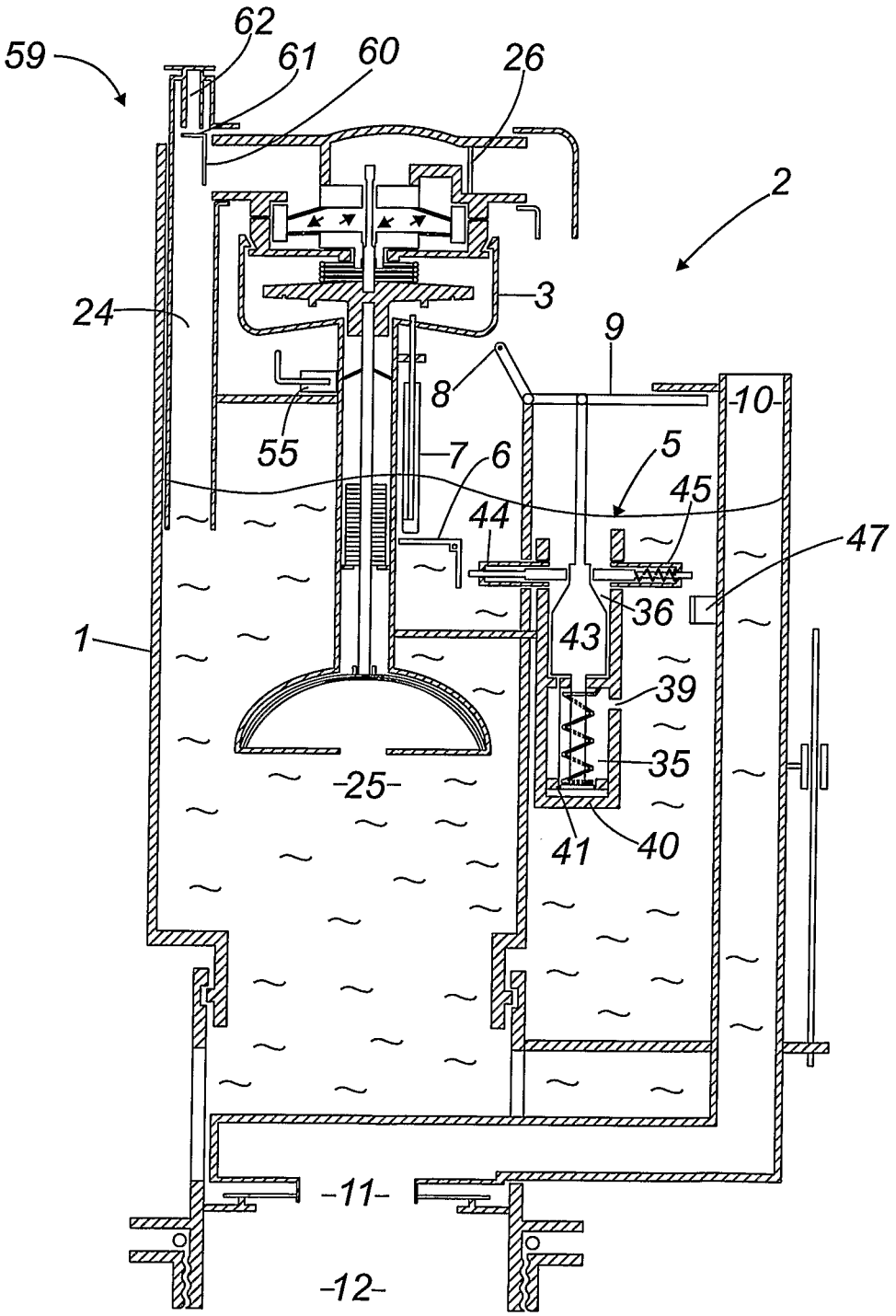
Figure 3:
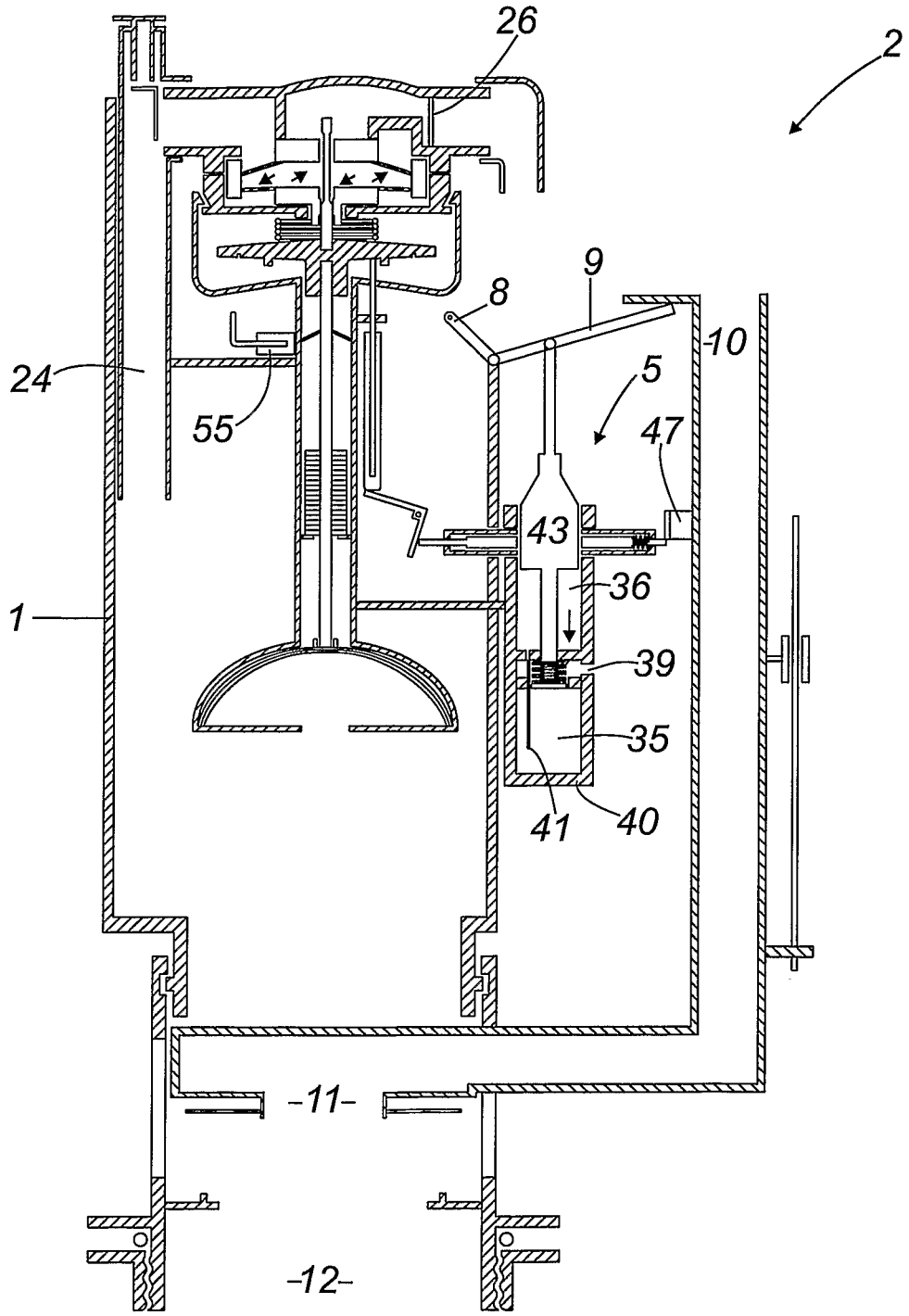
Figure 4:
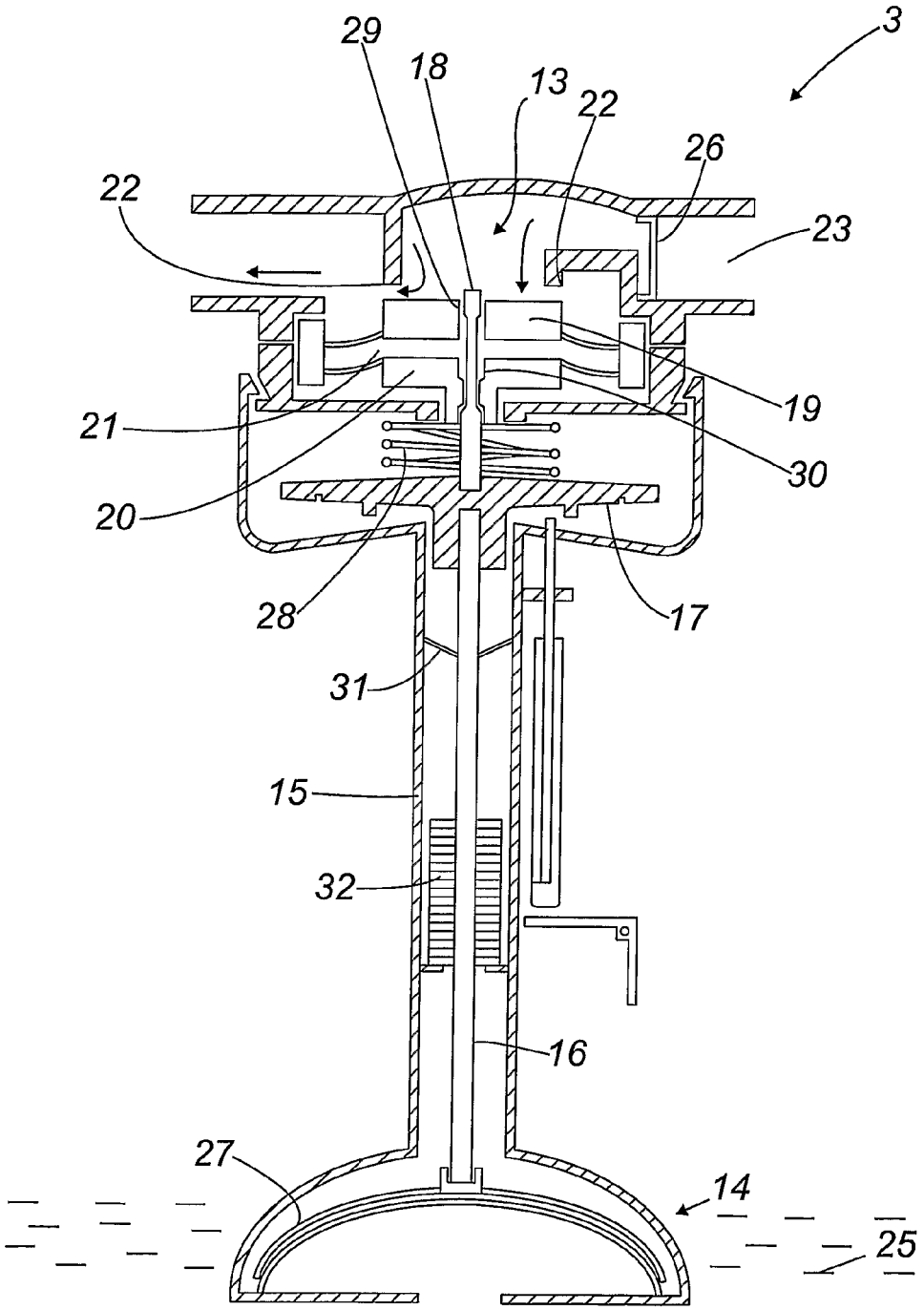
Figure 5:
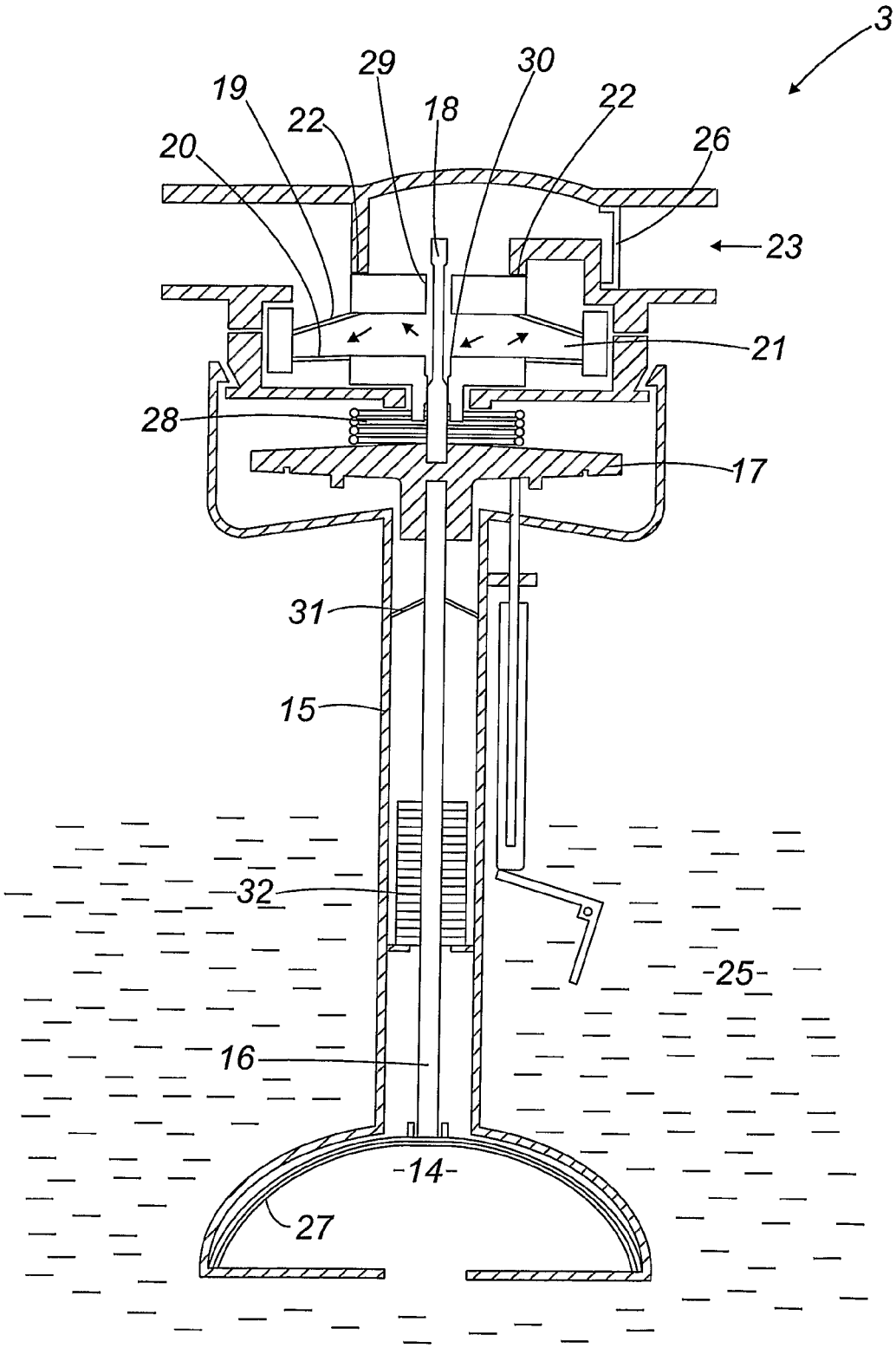
Figure 6:
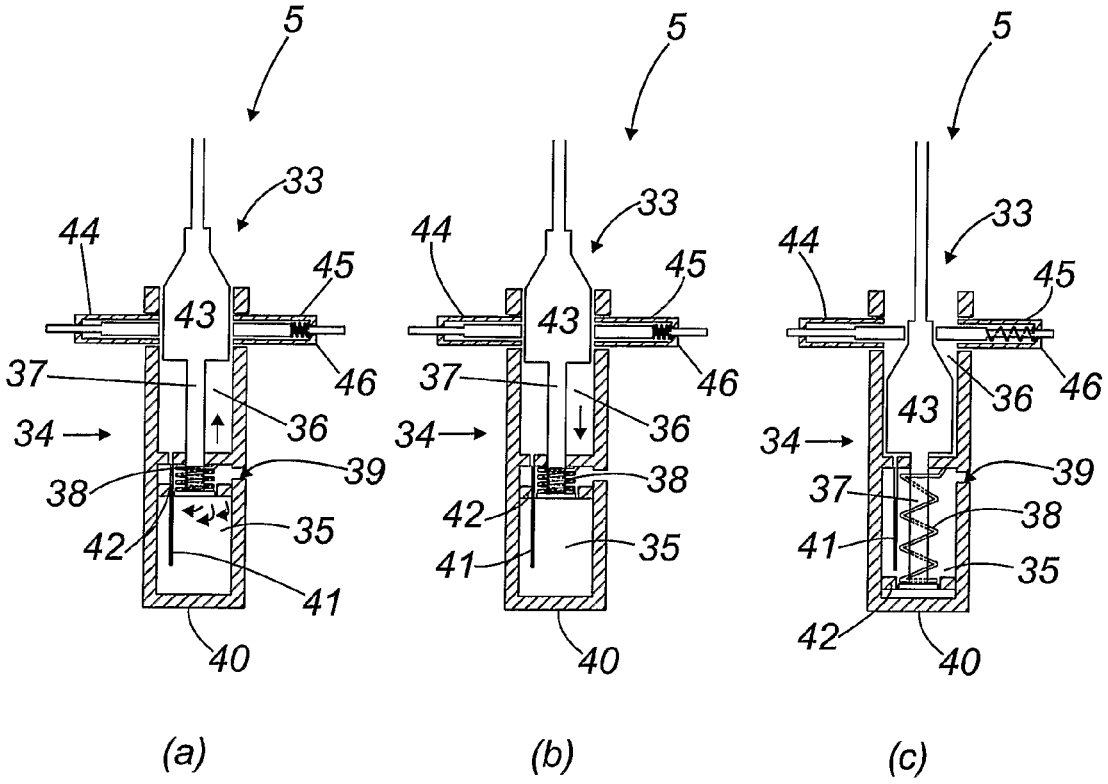
Figure 7:
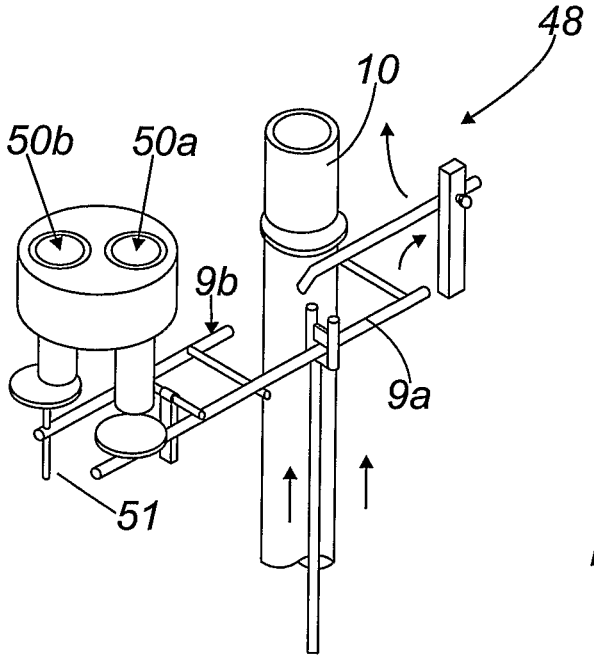
Figure 8:
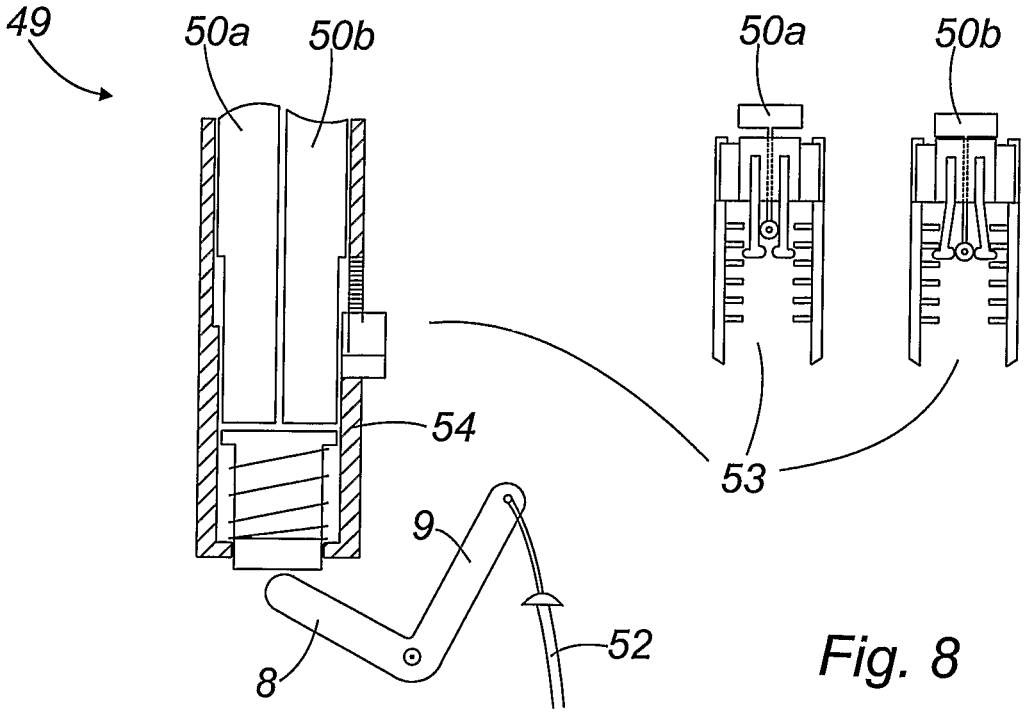
Figure 9:
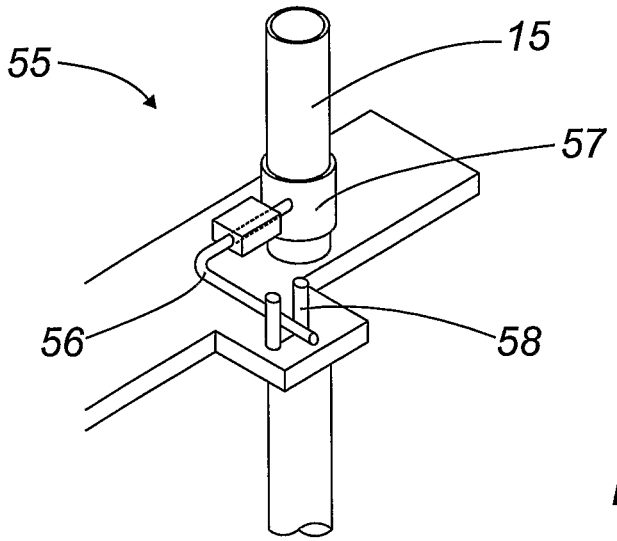
Figure 10:
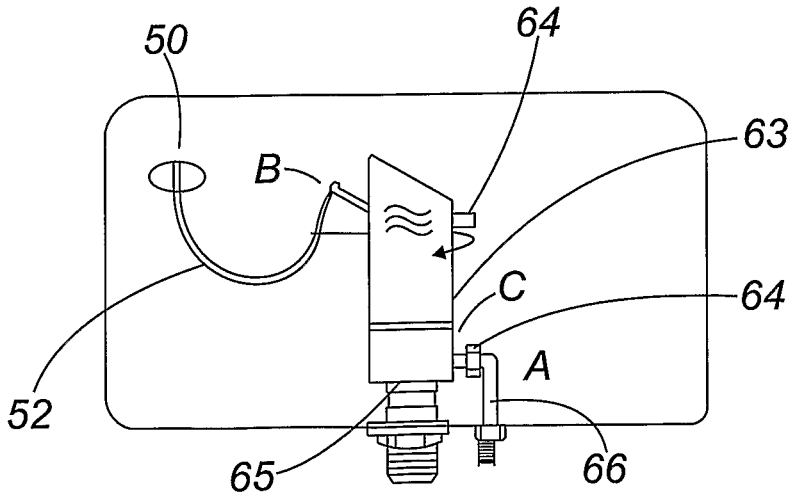

Embodiments of the present invention will now be described, by way of example, with reference to the accompanying drawings, in which:

FIG. 1 presents a schematic diagram of a cistern comprising a flushing valve in accordance with an aspect of the present invention, the cistern being empty of water;

FIG. 2 presents a schematic diagram of the cistern of FIG. 1, the cistern being full of water;

FIG. 3 presents a schematic diagram of the cistern of FIG. 1 with the lever activated so as to allow the cistern to empty of water;

FIG. 4 presents a schematic diagram of a double diaphragm pressure head inlet valve of the flushing valve in an open configuration;

FIG. 5 presents a schematic diagram of a double diaphragm pressure head inlet valve of the flushing valve in a closed configuration;

FIG. 6 presents three schematic diagrams of a timer valve of the flushing valve in an:

a) an open configuration;

b) a closing configuration; and c) a closed configuration;

FIG. 7 presents a schematic diagram of a dual flushing mechanism suitable for use within the flushing valve of FIG. 1;

FIG. 8 presents a schematic diagram of an alternative dual flushing mechanism suitable for use within the flushing valve of FIG. 1;

FIG. 9 presents a schematic diagram of a height adjuster for the inlet valve of FIGS. 4 and 5; and FIG. 10 presents a schematic diagram of the flushing valve in a cartridge form.

For consistency and clarity purposes the various features of the described flushing valve are referred to by the same reference numerals throughout the specification. Where appropriate, those reference numerals employed to describe the features common to alternative embodiments of the invention are also maintained within the specific description.

DETAILED DESCRIPTION

In order to assist understanding of the present invention, FIGS. 1 to 3 presents schematic diagrams of a cistern 1, comprising a flushing valve 2 in accordance with an aspect of the present invention, within three separate modes of operation. The flushing valve 1 can be seen to comprise three separate mechanically connected valves namely:

1) an inlet valve 3 in the form of a double diaphragm pressure head valve;
2) an outlet valve 4 in the form of a drop valve; and
3) a timer valve 5 mechanically connected to both the inlet and outlet valves.

The timer valve 5 is connected to the inlet valve 3 via an L-shaped lever 6 and a first rod 7. A lever 8 mechanically connects the timer valve 5, via a second rod 9 to the overflow tube 10 of the outlet drop valve 4. The outlet drop valve 4 further comprises a plug 11, made of a rubber, for control of the opening and closing an outlet tube 12 of the cistern 1. As described in detail below, the timer valve 5 is employed to systematically control the operation of the inlet 3 and outlet valves 4 so as to ensure that the cistern 1 cannot begin to refill with water, following the lever 8 being pressed by a user so as to activate the flushing of the toilet, until the outlet valve 4 has returned to its closed configuration.

Further detail of the double diaphragm pressure head inlet valve 3 is provided within FIGS. 4 and 5 which show the valve in an open and closed configuration, respectively. It should be noted that the operation of the double diaphragm pressure head inlet valve 3 is similar to that of the single diaphragm pressure head valve described in detail by the authors within their earlier PCT Application, namely PCT Publication No. WO 2005/001319.

The double diaphragm pressure head inlet valve 3 comprises a double diaphragm mechanism 13 and a single diaphragm mechanism 14 located at opposite ends of a sealed tube 15. Located within the sealed tube 15 is an inlet valve rod 16 which facilitates for the mechanical communication between the double diaphragm mechanism 13 and the single diaphragm mechanism 14. At the opposite end of the inlet valve rod 16 to the single diaphragm mechanism 14 is located a valve adjustment wheel 17 having attached to it a pin 18 that is threaded through an aperture located in first 19 and second diaphragms 20 of the double diaphragm mechanism 13. The first 19 and second diaphragms 20 are arranged so as to form a diaphragm chamber 21. The first diaphragm 19 further comprises two seals 22 the position of which determines whether or not the inlet valve 3 is in an open configuration, as shown in FIGS. 1 and 4, or a closed configuration, as shown in FIGS. 2, 3 and 5.

With the inlet valve 3 in the open configuration, water can flow from an inlet tube 23 across the top of the first diaphragm 19, into a silencer tube 24 and then on to fill the cistern 1 so as to create a pressure head 25.

To facilitate free movement of parts, and to prevent dirt or scale entering the inlet valve 3 a fine mesh filter 26 located at the entrance to the in the inlet tube When there is no water in the cistern 1 the inlet valve will automatically open since there is a loss of pressure energy when water starts to flow across the face of the first diaphragm 19. As the cistern 1 fills the pressure head 25 increases so providing a hydraulic force to the lower surface of the single diaphragm mechanism 14. This hydraulic force acts to raise single diaphragm mechanism 14. This movement is referred to as the "stroke" of the inlet valve 3, therefore the greater the pressure head 25 the greater the stroke. To improve the stroke the single diaphragm mechanism 14 comprises a fabric designed to present little resistance e.g. (synthetic rubber) and a cage 27 arranged to direct this force in a central direction.

As the single diaphragm mechanism 14 continues to rise, it engages with the inlet valve rod 16 which moves upwards along with the pin 18 which is fixed into the adjustment wheel 17. This action results in the compression of spring 28 of the adjustment wheel 17.

Pin 18 is arranged to have a central portion having a diameter that is less than the diameter of the ends of the pin 18. As such, when the pin 18 protrudes through the aperture in the first diaphragm 19 to the extent that the central portion aligns with this aperture, water is free to flow into the diaphragm chamber 21. Simultaneously however, the lower portion of the pin 18 locates within the aperture of the second diaphragm 20 so sealing this surface of the diaphragm chamber 21. The overall effect is that there is a build up of pressure within the diaphragm chamber 21.

When this pressure is equal to the incoming water supply pressure, the diaphragm chamber 21 expands to the extent that the seals close off orifices 29 and 30 so moving the inlet valve to its closed configuration. At this time the expansion of the diaphragm chamber 21 pushes it further over the lower portion the pin 18 so as to maintain the seal of the diaphragm chamber 21. Any water spillage is prevented from entering the sealed tube 15 by the tube seal 31.

When the water in the cistern 1 empties or is reduced, as in the case of a short flush there is a loss of upward force acting on the single diaphragm mechanism 14. This releases the energy built up in the spring 28 which forces the pin 18 and the inlet valve rod 16 to move downwards. The downward movement of the pin 18 thus acts to reseal the first diaphragm 19 while unsealing the second diaphragm 20. Water pressure is then released from the diaphragm chamber 21 and so the incoming water pressure acts to break seals 22, thus causing the inlet valve 3 to reopen. The refilling process is then free to start over.

To adjust the water level required to move the inlet valve 3 between its open and closed configurations, the valve adjustment wheel 17 is simply required to be turned. In the presently described embodiment a clockwise turn acts to reduce the distance between the inlet valve rod 16 and the single diaphragm mechanism 14 while an anti-clockwise turn acts to increase the distance between these components.

An automatic cut out device 32 is also incorporated within the double diaphragm pressure head inlet valve 3. The automatic cut out device 32 comprises a plurality of fibre washers located around the inlet valve rod 16. As such, when these washers become soaked with water, they expand generating an upward force which acts to move the inlet valve 3 to its closed configuration.

Further detail of the timer valve 5 will now be discussed with particular reference to FIG. 6. In particular, FIG. 6 presents three schematic diagrams of the timer valve 5, namely in a) an open configuration, b) a closing configuration, and c) a closed configuration.

With reference to the closed configuration of FIG. 6(*c*), the timer valve can be seen to comprise a piston rod 33 that is configured so as to be extractable from a timer chamber 34. The timer chamber 34 is spilt into a lower 35 and upper chamber 36. Located within the lower chamber 35 is a T-shaped section 37 of the piston rod 33 around which is positioned a timer valve spring 38. Positioned on one side of the lower chamber 35 is an exhaust hole 39 while a non return valve 40 is located on the T-shaped section 37. Depending from the top of the lower chamber 35 is a tapered needle 41 arranged to locate within an aperture 42 also positioned within the T-shaped section 37.

The upper chamber 36 is open at its top edge so as to allow for a tapered section 43 of the piston rod 33 to be extracted from the timer chamber 34. On opposite sides of the upper chamber 36 are located a first 44 and a second 45 pall.

As can be seen from FIG. 6, the extraction of the piston rod 33 from the timer chamber 34 results in the first 44 and second palls 45 being caused to extend outwards from the upper chamber 36 by the movement of the tapered section 43 of the piston rod 33. When the piston rod 33 is reintroduced to the timer chamber 34 the first 44 and second palls 45 are caused to return to their original retracted positions. The return of the first 44 and second palls 45 can be assisted by the presence of a pall spring 46, as shown explicitly within the second pall 45.

In an alternative embodiment it would be possible for the first pall 44 to be mounted on a first timer chamber and piston rod combination and the second pall 45 to be mounted on a second timer chamber and piston rod combination. By connecting the two piston rods to the second rod 9 the same controlled functionality on the inlet 3 and outlet valves 4 would be obtained. In a similar manner the timer valve could be employed to control a number of additional valves by incorporating additional palls, as appropriate.

The operation of the flushing valve 3 will now be described in detail. Before the lever 8 is activated to flush the toilet, the cistern 1 is within the mode of operation as presented in FIG. 2. When the lever 8 is pivoted downwards the second rod 9 interacts with the overflow tube 10 of the outlet drop valve 4 so as to move the plug 11 from its closed position to an open position thus allowing water to discharge from the cistern 1 so as to flush the toilet. Simultaneously, the second rod 9 acts to lift the piston rod 33 so as to extract it from the timer chamber 34. As the piston rod 33 is extracted the T-shaped section acts 37 to compress the timer valve spring 38. In addition, a partial vacuum is created within the lower chamber 35. This partial pressure causes the non-return valve 40 to open and water is drawn in to fill the space created.

As described previously, as the tapered section 43 of the piston rod 33 moves upwards the first 44 and second palls 45 are forced outwards until they become fully extended. The first pall 44 engages with the L-shaped lever 6 causing it to pivot resulting in the first rod 7 being moved in upward direction so as to be positioned underneath the valve adjustment wheel 17. Rod 7 therefore prevents the inlet valve 3 from opening while the toilet is being flushed.

At the same time the second pall 45 engages with a flexible flap 47 located on the exterior surface of the overflow tube 10. As the second rod 9 lifts the outlet valve 4 upwards the flexible flap 47 is forced back. Once the outlet valve 4 reaches its fully extended height the second pall 45 automatically drops underneath the flexible flap 47 thus holding the outlet drop valve 4 open while flushing of the toilet takes place.

This is the mode of operation shown in FIG. 3. At this stage the timer valve 5 is in the open position, as shown in FIG. 6(*a*) with its spring 38 compressed and the lower chamber 35 full of water caused by water entering through the non-return valve 40. Since water is non-compressible the piston rod 33 can not descend unless there is a means for its release. It is the aperture 42 in the T-shaped section 37 which provides the required release. Under the force of the spring 38 pushing down on the water contained in the lower chamber 35 the non-return valve closes 40 and the timer valve 5 starts to move back towards its closed position, see FIG. 6(*b*) since water can escape from the lower chamber 35 via aperture 42 and then exhaust hole 39.

It will be recognised that the downward movement of the piston rod 33 causes the spring 38 to continue to extend, resulting in a gradual loss in its force. To compensate for this effect, and to maintain a consistent flow rate, the tapered needle 41 is positioned so as to thread through the aperture 42 such that the available area of the aperture 42 increases as the piston rod 33 descends, therefore releasing more water. In this way a constant flow rate can be achieved as the piston rod 33 descends at a commensurate time rate.

As will be appreciated by those skilled in the art alternative embodiments may employ a parallel needle, or indeed no needle at all, particularly if the period of time for the decent of the piston rod 33 is deemed not to be that critical to the end user.

When the tapered section 43 descends into the upper chamber 36, the first 44 and second palls 45 retract. The retraction of the second pall 45, which is holding up the outlet drop valve 4, causes the plug 11 drop. This closes the outlet tube 12 thus completing the flush. The retraction of the first pall 44 allows for the inlet valve spring 28 to force the first rod 7 back to its starting position as shown in FIG. 1. The first rod 7 will remain in this position until it is reengaged by the activation of the lever 8.

The timer valve 5 is designed to prevent air from being trapped in its lower chamber 35 and it is the exhaust hole 39 that prevents this from happening. Trapped air would result in a shorter timing cycle. It is also preferable for the exhaust hole 39 to be fitted with a filter so as to prevent any small particles obstructing the non return valve 40.

In an alternative embodiment, the non return valve 40 may be moved from being located on the T-shaped section 37 so as to being located on the external surface of the lower chamber 35, for example the base of the lower chamber 35.

A further alternative would be to have a closed timer valve 5 design in which a predetermined amount of fluid e.g. water or air, is contained within the lower chamber 35 which now has to exhaust hole 39. The timing of the valve is then regulated by the controlled flow of water through apertures located in the T-shaped section 37.

From the above discussion it can be seen that the flushing valve 2 provides a mechanism whereby activation of the lever 8 results in the inlet valve 3 being held in its closed position while the outlet valve 4 is opened so as to commence the flush. It is the timer valve 5 which determines the period for which the inlet valve 3 and the outlet valve 4 remain in their closed and open positions, respectively. Once the timer valve 5 returns to its closed configuration the inlet valve 3 opens while the outlet valve 4 closes, thus allow the cistern 1 to refill. However, once the cistern 1 has filled to a predetermined level the inlet valve 3 again closes, and will remain closed until the lever 8 is activated again.

The amount of water discharged from the cistern 1 therefore depends directly on the distance the piston rod 33 is extracted from the timer chamber 34. As will be readily apparent, the extraction of the piston rod 33 can be pre-set so as to provide for either a full flush or a lesser discharge of water e.g. a half flush. Therefore the flush valve 2 can be easily adapted so as to satisfy local Water Regulations.

Dual Flushing

To illustrate this fact FIGS. 7 and 8 present two schematic diagrams of dual flushing mechanism, 48 and 49, suitable for use within the flushing valve 2.

The dual flushing mechanism 48 of FIG. 7 is of a lever type activated by rods 9*a* and 9*b* connected to operational buttons 50*a* and 50*b*. The buttons 50*a* and 50*b* are designed to be depressed by the same amount by a user move the same distance down. Button 50*b* however further comprises a button adjuster 51 which allows for the stroke of the piston rod 33 to be varied. If the adjuster 51 is screwed down button 50*b* has further to travel and the stroke imparted onto the piston rod 33 is reduced. Consequently, this reduces the time it takes to close the flushing valve 2 and hence determines the volume of water which is flushed. In the present arrangement depressing the button 50*a* acts to extract the piston rod 33 by the full amount from the timer chamber 34 so producing a full flush while button 50*b* is arranged so as to provide a half flush.

The dual flushing mechanism 49 of FIG. 8 is of a cable type again operated by buttons 50*a* and 50*b*. Button 50*a* is pre set so that when it is pushed down it maximises the lift on a cable 52 thus extracting the piston rod 33 by the full amount from the timer chamber 34 so as to produce a full flush.

However, as with the previously described embodiment, button 50*b* comprises an adjuster 53, which is fitted to an outside wall of a housing 54. Adjuster 53 incorporates a self locking mechanism that is employed to restrict its downward movement. Therefore, when adjuster 53 is moved upwards and set, it reduces the amount that button 50*b* can be depressed thus imparting a shorter stroke onto the piston rod 33. In the present arrangement depressing button 50*b* acts to extract piston rod 33 by an amount that provide for a half flush.

Height Adjustment Mechanisms

It will be appreciated that the flushing valve 2 is required to be fixed with respect to the high water level in the cistern 1 so as to ensure that the double diaphragm mechanism 13 of the inlet valve 3 is above the top of overflow tube 10.

To change the height of the inlet valve 3 a height adjuster 55 is fitted. Further detail of the height adjuster 55 is presented in FIG. 9 where it can be seen that the adjuster 55 comprises a right angle lever 56 having a horizontal helical thread integrated with a clamp 57 that is located around the sealed tube 15. If the right angle lever 56 is turned anti-clockwise it releases the sealed tube 15 from the clamp 57 so as to allow the inlet valve 3 to move freely. Once repositioned the right angle lever 56 is turned clockwise and locked into a clip 58 so again fixing the position of the inlet valve 3.

If desired, a height adjustment mechanism can also be employed in order to adjust the relative positioning of the first rod 7. For example, an adjuster 53 of the type described above in respect of the dual flushing mechanism of FIG. 8 may be adapted for this purpose. In this way the first rod 7 can be maintained in its correct working position between the valve adjustment wheel 17 and the L-shaped lever 6.

Overflow

Current UK legislation permits the use of an internal overflow where water can be allowed to escape through the flushing device. The overflow of the flushing valve 2 comprises the overflow tube 10 that is integrated within the outlet valve 4, see FIGS. 1 to 3. The overflow tube 10 can be either produced to a size that fits a particular manufacturer's cistern or with provision to fit into a whole range of cistern shapes and sizes. Therefore, the overflow tube 10 may be fitted with a telescopic part so as to allow its length to be extended or shortened, as required.

Back Pressure

If a connection on the water inlet pipe 23 located below the cistern 1 was temporarily opened it could act to siphon water from the cistern 1, through the inlet valve 3, and into the mains water supply, thus potentially contaminating the mains water. UK Water Regulations insist on the fitting of a mechanism to prevent such an occurrence.

In order to satisfy these regulations the flushing valve 2 further comprises a non-return valve 59 which is located within the silencer tube 24. The non-return valve of the presently described embodiment comprises a gate 60, which is mounted about a pivot 61, and an intake valve 62. In operation the flow of water from the inlet tube 23 forces the gate 60 to rotate through 90° to its open position. In this position the gate 60 directs the flow of water downwards. When the water outflow is complete the gate 60 returns to its former closed position. As a result, if water tries to back siphon it is restricted from doing so by the gate 60. Furthermore, air entering through the intake valve 62 acts to break the siphon's momentum, ensuring that no water passes that point.

Cartridge Form

The flushing valve 2 is designed so that it can be sold in the form of a cartridge 63, see FIG. 10. The cartridge 63 houses all of the above described components of the flushing valve 2. On the exterior surface of the cartridge 63 are two inlet ports 64 and an outlet port 65, each of which comprise a spigot end. In the presently described embodiment cable 52 is employed to connect the lever 8 to the operational buttons 50.

The spigot ends of the inlet ports 64 allows either of them to be attached to a flexible hose 66, the opposite end of which is attached to the cistern inlet valve 23. Inlet ports 64 thus provide alternative inlets for the flushing valve 2. in a similar manner, the spigot end of the outlet port 65 allows the cartridge 63 to be attached to the outlet tube 12 of the cistern 1.

Cartridge 63 therefore provides the flushing valve 2 with a simple and efficient means for attachment to, and/or removal from, the cistern 1. To remove the cartridge 63 the water supply to the cistern 1 is first turned off. The flexible hose 66 is then detached from the inlet port 64 and the cable 52 unhooked from the operational buttons 50. A clockwise turn then releases the cartridge 63 from the cistern outlet tube 12. The reverse of these actions can then be carried out to install a new unit.

The flushing valve 2 exhibits several advantages over those flushing valves known in the art. In the first instance the flushing valve reduces the level of water wastage experienced by a cistern when a toilet is flushed since it prevents any refilling of the cistern from taking place until the flushing action is complete. This is achieved through the systematic control of both the inlet valve 3 and outlet valve 4 by the timer valve 5. It is found that the employment of the flushing valve 2 saves, on average, around one liter of water per flushing action of a standard cistern.

It will be readily apparent that a number of alternative inlet 3 and/or outlet valves 4 may be employed within the flushing valve 2. However a significant advantage resides in the employment of the double diaphragm pressure head inlet valve 3, as described above, as compared to those valves described by the authors within their earlier PCT Application. This advantage resides in the fact that this valve employs the double diaphragm mechanism 13. Having a double walled upper diaphragm significantly assists in the prevention of water hammer effects since the double diaphragm mechanism 13 functions by its global shape acting to trap water between two flexible walls, any excessive pressure momentarily acting on the first diaphragm 19, which could create water hammer, is simply absorbed i.e. the double diaphragm mechanism 13 acts as a shock absorber.

A further of employing the double diaphragm pressure head inlet valve 3 lies in the fact that such inlet valves are significantly more mechanically robust, and hence reliable, than the traditional ball float inlet valve.

Further advantages of the flushing valve 2 reside in its relatively simple design. In the first instance the design of the flushing valve 2 makes it highly suitable for incorporation within a dual flushing system. In addition the flushing valve 2 can easily be incorporated within a cartridge 63 making the flushing valve 2 both easy to fit and easy to replace, as and when required. These factors should assist in reducing the requirement for repairs along with their associated costs.

The foregoing description of the invention has been presented for the purpose of illustration and description, and is not intended to be exhaustive or to limit the invention to the precise form disclosed. The described embodiments were chosen and described in order to best explain the principals of the invention and its practical applications, to thereby enable others skilled in the art to best utilise the invention in various embodiments and with various modifications as are suited to the particular use upon completion. Therefore, further modifications and improvements may be incorporated without departing from the scope of the appended claims.

The invention claimed is:

1. A flushing valve for controlling the flush of a cistern, the flushing valve comprising:

an inlet valve;

an outlet valve; and a timer valve;

the timer valve being mechanically connected to both the inlet valve and the outlet valve so as to control their movement between an open and a closed position;

wherein the timer valve is adapted so as to prevent both the inlet valve and the outlet valve from simultaneously being in their open positions;

wherein a flushing of the cistern causes the timer valve to move the flushing valve from a first configuration where the inlet valve and the outlet valve are in their closed positions to a second configuration where the inlet valve remains closed while the outlet valve moves to its open position;

wherein the timer valve maintains the flushing valve in the second configuration for a predetermined time period before moving the flushing valve to a third configuration wherein the outlet valve is closed while the inlet valve moves to its open position; and wherein the inlet valve comprises a pressure head valve for use with a variable head of fluid, the pressure head valve comprising a first diaphragm mechanism and pressure transfer apparatus, wherein the pressure transfer apparatus comprises a rod for transferring a fluid pressure associated with the variable head of the fluid to the first diaphragm mechanism so as to move the inlet valve between an open configuration and a closed configuration.

2. A flushing valve as claimed in claim 1, wherein the timer valve comprises a timer valve chamber and a piston rod arranged to move between an extended and retracted configuration relative to the timer valve chamber.

3. A flushing valve as claimed in claim 2, wherein the piston rod is biased towards the retracted configuration.

4. A flushing valve as claimed in claim 2, wherein the timer valve further comprises a pivotable rod attached to both the piston rod and a flushing mechanism of the cistern and adapted to interact with the outlet valve wherein activation of the flushing mechanism acts to pivot the rod so as to move the piston rod between its retracted and extended configuration and to move the outlet valve from its closed position to its open position.

5. A flushing valve as claimed in claim 2, wherein the timer valve further comprises a first pall adapted to move from a retracted configuration to an extended configuration as the piston rod moves from its retracted configuration to its extended configuration wherein when the first pall is in the extended configuration the inlet valve is held in its closed configuration.

6. A flushing valve as claimed in claim 2, wherein the timer valve further comprises a second pall adapted to move from a retracted configuration to an extended configuration when the piston rod moves from its retracted configuration to its extended configuration wherein when the second pall is in the extended configuration the outlet valve is held in its open configuration.

7. A flushing valve as claimed in claim 2, wherein the timer valve chamber comprises a first chamber adapted to house a first section of the piston rod wherein the first section of the piston rod has a tapered external surface arranged to interact with both the first and second palls.

8. A flushing valve as claimed in claim 7, wherein the timer valve chamber further comprises a second chamber adapted to house a second section of the piston and a spring for biasing the piston rod towards its retracted configuration.

9. A flushing valve as claimed in claim 8, wherein the second chamber further comprises a non-return valve wherein the non return valve moves from a closed position to an open position as the piston rod is moved towards its extended configuration.

10. A flushing valve as claimed in claim 8, wherein the second chamber further comprises an exhaust wherein the exhaust provides a means for fluid to exit the second chamber as the piston rod moves from its extended configuration to its retracted configuration.

11. A flushing valve as claimed in claim 10, wherein the second section of the piston comprises a T-shaped body upon which is located an aperture wherein fluid must pass through the aperture before exiting the second chamber via the exhaust.

12. A flushing valve as claimed in claim 11, wherein the second chamber further comprises a needle arranged to locate with the aperture.

13. A flushing valve as claimed in claim 12, wherein the needle is tapered such that a rate at which fluid passes through the aperture is constant.

14. A flushing valve as claimed in claim 1, wherein the inlet valve comprises a non-return valve located so as to prevent water exiting the cistern via the inlet valve.

15. A flushing valve as claimed in claim 1, wherein the first diaphragm mechanism comprises two diaphragms adapted to form a diaphragm chamber and a pin located so as to pass through apertures located within the two diaphragms.

16. A flushing valve as claimed in claim 1, wherein the pressure transfer apparatus comprises a second diaphragm mechanism arranged so as to interact with a first end of an inlet valve rod wherein a second end of the inlet valve rod is arranged so as to control a position of a pin relative to a diaphragm chamber.

17. A flushing valve as claimed in claim 16, wherein the pressure transfer apparatus further comprises an adjuster wherein the adjuster provides a water-adjustment wheel for changing a relative separation between the second diaphragm mechanism and the first end of an inlet valve rod.

18. A flushing valve as claimed in claim 1, wherein the inlet valve further comprises an automatic cut out valve wherein the automatic cut out valves causes the inlet valve to move to its closed position when a volume of water within the cistern rises above a predetermined value.

19. A flushing valve as claimed in claim 18, wherein the automatic cut out valve comprises a plurality of fibre washers located around an inlet valve rod.

20. A flushing valve as claimed in claim 1, wherein the outlet valve comprises a drop valve.

21. A flushing valve as claimed in claim 20, wherein the drop valve comprises an overflow tube.

22. A flushing valve as claimed in claim 21, wherein the drop valve further comprises a flexible flap located on the overflow tube wherein the flexible flap is arranged so as to interact with a second pall.

23. A flushing valve as claimed in claim 2, wherein the flushing valve further comprises a dual flushing mechanism wherein the dual flushing mechanism comprises a first mechanism, activation of which fully extends the piston rod from the timer valve chamber, and a second mechanism, activation of which only partially extending the piston rod from the timer valve chamber.

24. A flushing valve as claimed in claim 23, wherein the second mechanism comprises an adjuster which allows an amount by which the piston rod is partially extended from the timer chamber to be varied.

25. A flushing valve as claimed in claim 1, wherein the flushing valve further comprises height adjuster that comprises a right angle lever for adjusting the height of the inlet valve relative to the timer valve.

* * * * *